United States Patent [19]

Eggert et al.

[11] Patent Number: 4,730,092

[45] Date of Patent: Mar. 8, 1988

[54] HYDRAULIC DRIVING DEVICE FOR AN ELECTRIC PRESSURIZED-GAS SWITCH

[75] Inventors: Horst Eggert; Wolfgang Jacobsen, both of Berlin, Fed. Rep. of Germany

[73] Assignee: Siemens Aktiengesellschaft, Munich, Fed. Rep. of Germany

[21] Appl. No.: 940,845

[22] Filed: Dec. 12, 1986

[30] Foreign Application Priority Data

Dec. 20, 1985 [DE] Fed. Rep. of Germany ..... 3545782

[51] Int. Cl.[4] ..... H01H 35/38; H01H 33/88

[52] U.S. Cl. ..... 200/82 B; 200/148 F

[58] Field of Search ..... 200/148 E, 82 B, 148 F

[56] References Cited

U.S. PATENT DOCUMENTS

| | | | |
|---|---|---|---|
| 3,050,079 | 8/1962 | Tognella | 137/568 |
| 3,526,243 | 9/1970 | Warnemuende et al. | 200/148 F |
| 3,832,502 | 8/1974 | Grieger et al. | 200/82 B |
| 4,101,746 | 7/1978 | Grieger et al. | 200/82 B |
| 4,581,510 | 4/1986 | Bischofberger et al. | 200/148 F |

FOREIGN PATENT DOCUMENTS

| | | |
|---|---|---|
| 1221709 | 7/1966 | Fed. Rep. of Germany . |
| 1525857 | 12/1969 | Fed. Rep. of Germany . |
| 7736316 | 11/1979 | Fed. Rep. of Germany . |

OTHER PUBLICATIONS

Siemens-Zeitschrift, No. 43, (1969), pp. 285-287.

*Primary Examiner*—Robert S. Macon
*Attorney, Agent, or Firm*—Kenyon & Kenyon

[57] ABSTRACT

In a hydraulic driving device for an electric pressurized-gas switch, the piston-cylinder systems are responsive to pressure from a hydropneumatic pressure accumulator. The driving device is equipped with a hydraulic pump which feeds several pressure accumulators and is controlled by pressure monitors, and with a gas monitoring device for the pressure monitors. For solving the problem of carrying out indirect gas monitoring while feeding several pressure accumulators by one hydraulic pump instead of direct gas monitoring, there is provided at least one threshold switch for measuring the feed pressure of the hydraulic pump as part of the gas monitoring device. By feeding the pressure accumulators which takes place sequentially in time and is controlled on the one hand by the gas monitoring device and by the pressure monitors on the other hand, it is possible to establish a correlation specific as to the pressure accumulator of the gas loss signal delivered by the threshold switch.

12 Claims, 2 Drawing Figures

HYDRAULIC DRIVING DEVICE FOR AN ELECTRIC PRESSURIZED-GAS SWITCH

BACKGROUND OF THE INVENTION

The present invention relates to an hydraulic driving device for an electric pressurized-gas switch, of which the piston-cylinder systems can each be acted upon by a hydropneumatic pressure accumulator (pressurizer) having a hydraulic pump which feeds several pressure accumulators and is controlled by pressure monitors, and having a gas-monitoring device for the pressure accumulators.

In such a known hydraulic driving device, for instance, a Siemens circuit breaker 3AS2, 362 kV, the gas monitoring is accomplished directly, i.e., the position of a piston movable in the pressure accumulator is determined, for instance, by mechanical means and is evaluated. Direct gas monitoring requires these mechanical means in multiple, according to the number of pressure accumulators used. The mechanical means make possible the generation, specific as to the pressure accumulator, of one or more gas loss signals.

In known hydraulic driving devices, such gas loss signals specific as to the pressure accumulator, for instance, of a Siemens circuit breaker 3AS2, 150 to 300 kV, are generated through the use of indirect gas monitoring.

The gas content of a pressure accumulator is determined here indirectly via the pressure of the hydraulic liquid if the piston has reached a given stop position. This position can be fixed by a stop so that the hydraulic pump works against a quasi-incompressible medium after this position is reached. Thereby, the hydraulic pressure increases steeply and leads to the delivery of the signal of a pressure monitor which is associated with the pressure accumulator.

If one hydraulic pump feeds several pressure accumulators and, for instance, a gas loss occurs in one of the pressure accumulators, the steep pressure buildup is distributed in this pressure accumulator directly to all pressure accumulators fed by the hydraulic pump, so that an occurring correlation specific as to the pressure accumulator occurring or a gas-loss signal is not possible. For this reason, indirect gas monitoring is used in the known systems if one hydraulic pump is provided for each pressure accumulator.

SUMMARY OF THE INVENTION

It is an object of the present invention to provide, for a hydraulic driving device of the type mentioned above, indirect gas monitoring instead of direct gas monitoring if several pressure accumulators are fed by one hydraulic pump.

The above and other objects of the present invention are achieved by an hydraulic driving device for an electric pressurized-gas switch having a piston-cylinder system comprising a plurality of piston-cylinders for operating respective switch contacts, each of said piston-cylinders being responsive to an hydropneumatic pressure accumulator, an hydraulic pump being provided for supplying several of said pressure accumulators, each of said pressure accumulators being controlled by a pressure monitor which monitors the pressure in a feed line to the respective accumulator, and further comprising a gas monitoring device for the pressure accumulators, the gas monitoring device having at least one threshold switch for measuring an output pressure of the hydraulic pump and further comprising means for controlling the hydraulic pump to supply hydraulic fluid to the pressure accumulators sequentially in time responsive to the gas monitoring device and the pressure monitors.

By the application of the invention, the functional advantages of direct gas monitoring are combined with those of indirect gas monitoring.

The need for hydraulic pumps is comparatively small. The fixed correlation in time of each pressure accumulator to the hydraulic pump feeding it assures for each occurring gas loss signal at the same time the functional, and thereby, structural association of the fault source and the type of fault. Thus, designs can be created, for instance, which are mechanically simple and rugged because a large amount of mechanical auxiliary devices is not necessary. In particular, the cost of gas seals is kept low. A comparatively high freedom from disturbances and service friendliness are the result.

In one advantageous embodiment of the invention, the threshold switch can be arranged in a main feedline common to all pressure accumulators, so that only one threshold switch needs to be provided for gas monitoring all pressure accumulators provided. Above a given nominal hydraulic pressure, this threshold switch delivers a gas-loss signal which can be converted, for instance, into a visual or acoustical warning signal or interrupts as a blocking signal the function of the hydraulic pump and possibly of the driving device.

In a further embodiment of the invention, the sequence of the pressure accumulator feeding in time can be accomplished by feeding every pressure accumulator via a magnetic valve of its own. Between the pressure accumulator and the magnetic valve, the pressure monitors can each be arranged in the feed line; the pressure monitor opens the associated magnetic valve if the pressure falls below a minimum value in the feedline of the pressure accumulator, and switches the hydraulic pump on. At the same time the pressure monitor can lock the magnetic valves of other pressure accumulators in their closed position so that the hydraulic oil is transported exclusively into the corresponding pressure accumulator.

When one of the magnetic valves is opened, an associated self-locking device can advantageously be switched on which maintains the switching state independently of the signal of the controlling pressure monitor and is interrupted again after the nominal hydraulic pressure is reached in dependence on a pump delay time and thereby switches the hydraulic pump off. This interruption can close the associated magnetic valve and unlatch the magnetic valves of the other pressure accumulators.

In a particularly advantageous and simple embodiment of the invention, each pressure monitor controls a contactor which, as a mass-produced element, is of mechanically simple design, is inexpensive and relatively disturbance-free. The sequence of feeding, unambiguous in time, can be assured particularly simply by the provision that the contactors have different excitation times. Here, the contactor with the fastest excitation time, for instance, opens the corresponding magnetic valve so that the corresponding pressure accumulator can be filled first while all other magnetic valves remain in their closed position.

For obtaining a simple circuit arrangement, it is advantageous if each contactor contains a self-locking contact, a valve contact, a pump contact and a signalling contact as a make contact, as well as an interlock contact for every further magnetic valve as a break contact.

The signalling contacts of the contactors can be connected in parallel and control the signal, connected in series with the threshold switch. It is possible that the signalling contact of the contactors and the threshold switch form the indirect-action gas monitoring device. Also in this case, the threshold switch can be a simple pressure monitor.

BRIEF DESCRIPTION OF THE DRAWINGS

The invention will be explained in greater detail in the following detailed description, with reference to the drawings, in which.

DETAILED DESCRIPTION

Figure 1:
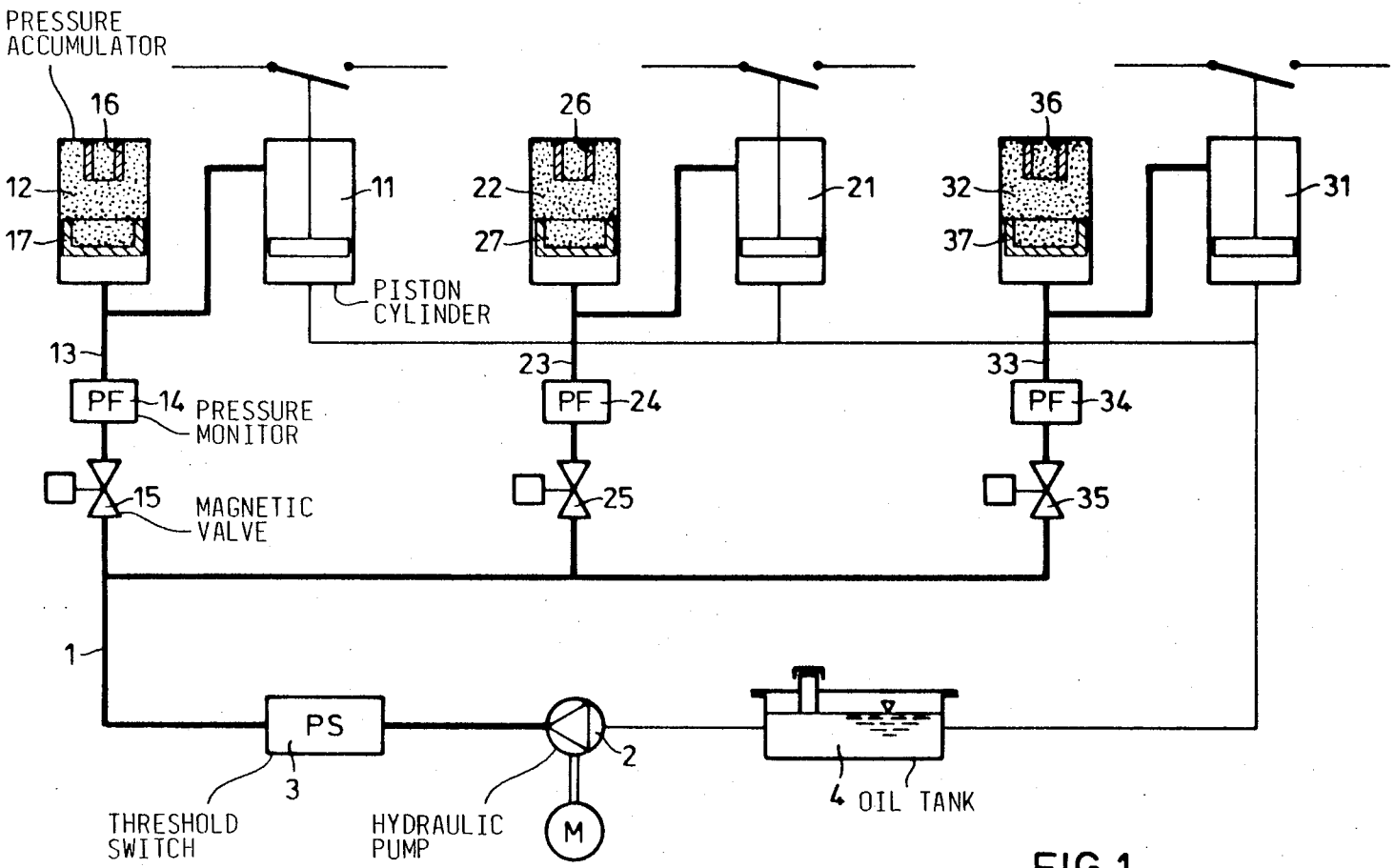
FIG. 1 shows a basic circuit diagram for the control circuit of an hydraulic driving device according to the invention for a pressurized gas switch.

In FIG. 1, three piston-cylinder systems 11, 21, 31 for actuating the switching gaps of a three-pole electric pressurized-gas switch are shown, for instance, of an SF6 switch, which are each controlled by a hydraulic pressure accumulator 12, 22, 32 each containing a gaseous atmosphere. In the feedlines 13, 23, 33 are located pressure monitors 14, 24, 34 and magnetic valves 15, 25, 35. In the main feedline 1 which is common to all pressure accumulators 12, 22, 32, a hydraulic pump 2 and a threshold switch 3 are arranged.

The pressure monitors 14, 24, 34 monitor the operating pressure PF of the pressure accumulators 12, 22, 32 and switch the hydraulic pump 2 on and off in dependence thereon. The threshold switch determines the disturbance pressure PS which is above a predetermined nominal hydraulic pressure. It furnishes a signal if the disturbance pressure PS occurs in the main feedline.

The bold lines in FIG. 1 represent schematically high-pressure lines. The hydraulic oil loop is closed by lines without pressure which are shown as thin lines. The hydraulic oil is returned through these pressureless lines from the piston-cylinder system 11, 21, 31 to an oil tank 4 which in turn then feeds the hydraulic pump 2.

Figure 2:
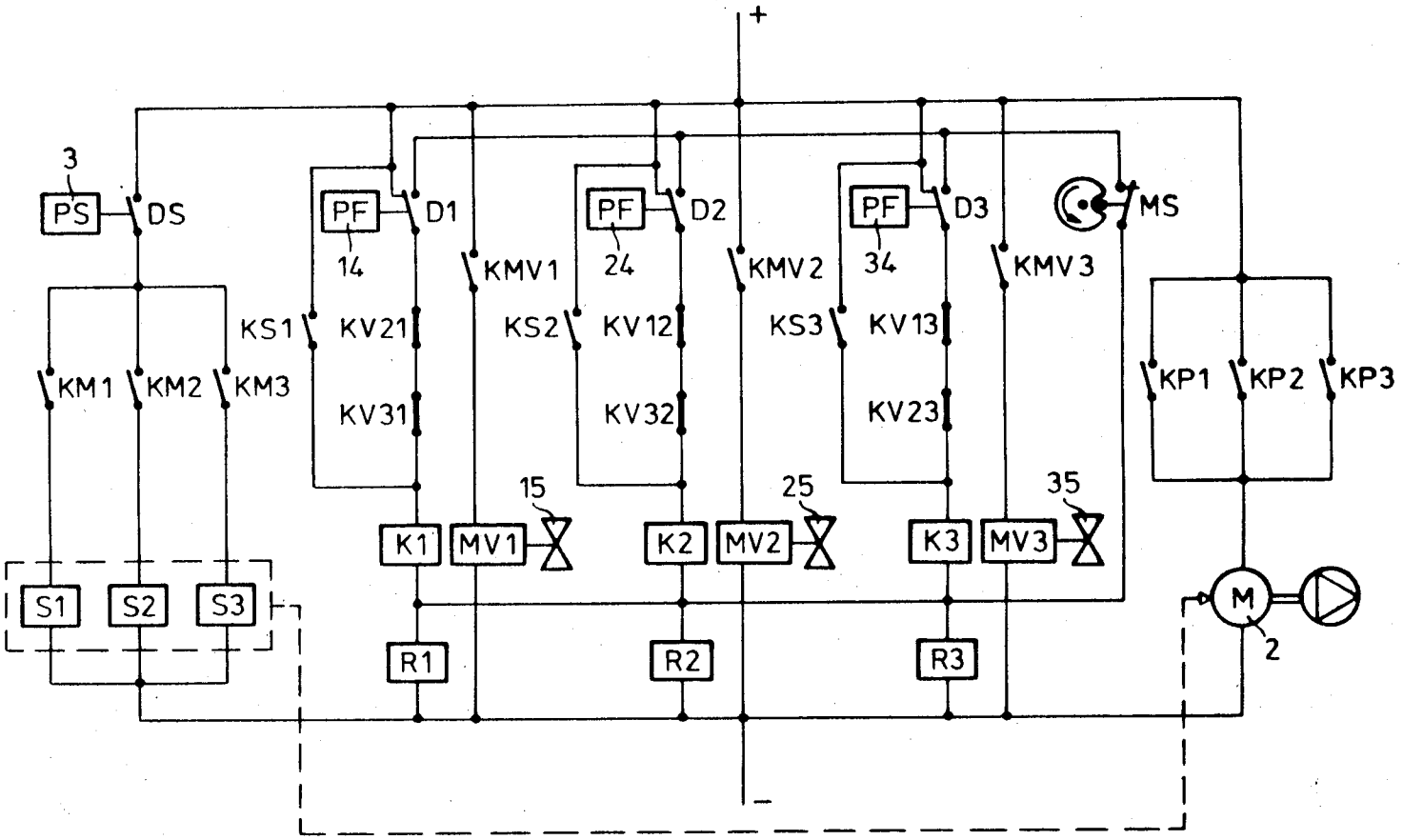
FIG. 2 shows an associated electric circuit diagram for controlling the hydraulic driving device according to FIG. 1.

If, for instance, the pressure in the feedline 23 falls below the required minimum pressure, the pressure monitor 24 responds. Thereupon, the magnetic valve 25 is opened and the magnetic valves 15 and 35 are electrically locked in their closed position. At the same time, the hydraulic pump 2 is switched on. When the pressure accumulator 22 reaches the required nominal pressure, the magnetic valve 25 is closed again after a certain delay time and the hydraulic pump 2 is switched off. This purpose is served by a microswitch MS which is shown in FIG. 2 and is controlled by the pump shaft by means of a cam; the microswitch makes the off signal effective with delay after a nominal value of the pressure is reached. If, during this delay time, the hydraulic pressure rises above the intended nominal pressure with a steep slope (this is the case if there is not enough gas in the pressure accumulator 22), the threshold switch 3 responds and delivers the gas-loss signal. This signal can lead to a visual or acoustic alarm. It can also serve as a blocking signal for switching the hydraulic pump 2 off. Since at the time of the gas loss signal only the pressure accumulator 22 was being fed by the hydraulic pump 2, the gas loss signal that has occurred is unequivocally associated with this one pressure accumulator 22.

The steep pressure rise is triggered by a stop 16, 26, 36 which limits the motion of a piston 17, 27, 37 mechanically, which can be reached by the piston under operating conditions only if the amount of gas is insufficient. In this case, the pump alone works against the quasi-incompressible hydraulic oil.

The circuit arrangement shown in FIG. 2 comprises several parts, namely, the gas monitor, the pressure-dependent valve control, the time delay circuit and the pump control.

If, for instance, the functional pressure PF of the pressure accumulator 22 drops below its lower limit, a pressure monitor contact D2 of the pressure monitor 24 responds and goes into the closing position opposite that shown in FIG. 2. Thereby, a contactor K2 is energized and its contacts are switched from the rest positions shown to the operating positions. A self-locking contact KS2 and a signaling contact KM2 are closed. Further closed is a valve contact KMV2 so that a valve control device MV2 opens the magnetic valve 25. At the same time, a pump contact KP2 is closed so that the hydraulic pump 2 is switched on and fills the pressure accumulator 22.

At the same time, locking contacts KV21 and KV23 are opened. Thereby, the contacts K1 and K3 are made without current, i.e., the associated contacts are in their rest position and the magnetic valves 15 and 35 are closed.

When the hydraulic pressure in the pressure accumulator 22 has reached its preset nominal value, the pressure monitor contact D2 is switched. Via the closed self-locking contact KS2, the contactor K2 remains energized so that the hydraulic pump 2 continues to run. If during this delay time the hydraulic pressure rises steeply above its nominal value, a pressure monitor contact D5 is closed which in the executed example is the contact of the threshold switch 3, whereby a gas loss signal is generated via a signaling device S2.

The dashed line between the motor of the hydraulic pump 2 and the signaling device S1, S2, S3 indicates that a signal can lead to an operating blockage of the hydraulic pumb 2. If the hydraulic pressure does not rise appreciably above the nominal pressure during the pump delay time, closing the microswitch MS leads to a short circuit of the contactor K2, whereby the contactor contacts all return to the rest position and the self-locking feature is cancelled.

When the pressure accumulators 12, 22, 32 are filled for the first time, all pressure monitors D1, D2, D3 are closed. However, that contactor is then energized first which has the shortest excitation time. Also in this operating case, an unequivocal time sequence of feeding the pressure accumulator is assured reliably.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An hydraulic driving device for an electric pressurized-gas switch having a piston-cylinder system comprising a plurality of piston-cylinders for operating respective switch contacts, each piston-cylinder being respective to a respective hydropneumatic pressure accumulator supplied by an hydraulic pump which feeds a plurality of said pressure accumulators, a respective pressure monitor being associated with each accumulator which monitors the pressure in a feedline to the respective accumulator, and further comprising a gas monitoring device for the pressure accumulators, said gas monitoring device comprising a threshold switch for measuring an output pressure of the hydraulic pump, said hydraulic pump being responsive to each of said pressure monitors on an individual basis to supply hydraulic fluid to a selected one of said accumlators associated with a particular one of said pressure monitors indicating a low pressure in the feedline supplying the respective accumulator, said hydraulic pump also being responsive to said threshold switch in the event the fluid pressure to a respective accumulator increases beyond a predetermined threshold if the gas pressure in an accumulator falls below a predetermined limit value.

2. The hydraulic driving device recited in claim 1, wherein the threshold switch is disposed in a main feedline common to all pressure accumulators, said threshold switch delivering a gas loss signal when the hydraulic pressure in the main feedline exceeds a preset nominal hydraulic pressure.

3. The hydraulic driving device recited in claim 1, wherein each pressure accumulator is fed via a respective magnetic valve means, a pressure monitor being disposed in a feedline between the pressure accumulator and the magnetic valve means.

4. The hydraulic driving device recited in claim 3, wherein the respective pressure monitor opens a corresponding magnetic valve means when the pressure in the feedline of the respective pressure accumulator falls below a minimum value, and further comprising means for locking the magnetic valve means of the other pressure accumulators in a closed condition at such time, and means for switching on the hydraulic pump at such time.

5. The hydraulic driving device recited in claim 4, wherein an associated self-locking device is switched on upon opening one of the magnetic valve means which is interrupted again only after a nominal hydraulic pressure is reached in dependence on a pump delay time, thereby switching off the hydraulic pump.

6. The hydraulic driving device recited in claim 5, wherein the interruption of the self-locking device closes the associated magnetic valve means and unlocks the magnetic valve means of the other pressure accumulators.

7. The hydraulic driving device recited in claim 1, wherein each pressur monitor controls a contactor arrangement.

8. The hydraulic driving device recited in claim 7, wherein the contactor arrangements have different excitation times.

9. The hydraulic driving device recited in claim 7, wherein each contactor arrangement comprises a self-locking contact, a valve contact, a pump contact and a signalling contact for activating a signalling device for a respective pressure accumulator comprising a normally open contact and at least one locking contact for each further magnetic valve means comprising a normally closed contact.

10. The hydraulic driving device recited in claim 9, wherein the signaling contacts of the contactor arrangements are connected in parallel and then in series with the threshold switch.

11. The hydraulic driving device recited in claim 9 wherein the signaling contacts of the contactor arrangements and the threshold switch form an indirectly-acting gas monitoring device.

12. The hydraulic driving device recited in claim 1, wherein the threshold switch is a pressure monitor.

* * * * *